US007698794B2

(12) United States Patent
Cobzaru

(10) Patent No.: US 7,698,794 B2
(45) Date of Patent: Apr. 20, 2010

(54) LOAD CONTROL MECHANISM FOR PULL TYPE TOOLS

(75) Inventor: Cristinel Ovidiu Cobzaru, Murrieta, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 250 days.

(21) Appl. No.: 11/733,485

(22) Filed: Apr. 10, 2007

(65) Prior Publication Data

US 2007/0286698 A1 Dec. 13, 2007

Related U.S. Application Data

(60) Provisional application No. 60/745,107, filed on Apr. 19, 2006.

(51) Int. Cl.
*B23Q 3/06* (2006.01)
*F16H 21/00* (2006.01)

(52) U.S. Cl. ..... 29/256; 29/255; 29/270

(58) Field of Classification Search ..... 29/256, 29/255, 264–267, 270, 278
See application file for complete search history.

(56) References Cited

U.S. PATENT DOCUMENTS 4,059,883 A * 11/1977 Osborne ..... 29/259
4,309,123 A * 1/1982 Moore ..... 403/408.1
4,732,518 A 3/1988 Toosky
4,798,106 A * 1/1989 Foster ..... 81/3.29
5,096,349 A 3/1992 Landy et al.
5,245,743 A 9/1993 Landy et al.
5,405,228 A 4/1995 Reid et al.
5,425,164 A 6/1995 El Dessouky
5,604,967 A * 2/1997 McMahon ..... 29/263
6,601,277 B1 * 8/2003 Swanson ..... 29/256
6,910,252 B2 * 6/2005 Draggie et al. ..... 29/263
7,059,816 B2 6/2006 Toosky
7,114,900 B2 10/2006 Toosky
2006/0075617 A1 * 4/2006 Toosky et al. ..... 29/256
2007/0286698 A1 * 12/2007 Cobzaru ..... 411/113

* cited by examiner

*Primary Examiner*—Lee D Wilson
(74) *Attorney, Agent, or Firm*—Trexler, Bushnell, Giangiorgi, Blackstone & Marr, Ltd.

(57) ABSTRACT

A load control mechanism for use with a pull type tool (also called a riveter), wherein the mechanism includes a telescopic housing and a compressible element, such as a polyurethane compression spring, which works to limit the ultimate load which is applied by the pull type tool during operation, such as during removal of a rivetless nut plate from a hole in parent material. Also provided is a method of removing a rivetless nut plate by using a pulling head which includes a shock absorber and load limiting device, a resetion cup and a mandrel. The load control mechanism provides that a riveter can be used to safely remove a rivetless nut plate without causing damage or undue wear on components of the tool. This load control mechanism also absorbs operating shocks, protecting expensive work parts (ex: aircraft structure) and the operator during operation, resulting in a safe and ergonomic operation.

18 Claims, 7 Drawing Sheets

LOAD CONTROL MECHANISM FOR PULL TYPE TOOLS

RELATED APPLICATION

Priority Claim

This application claims the benefit of U.S. Provisional Application Ser. No. 60/745,107, file Apr. 19, 2006, which is hereby incorporated by reference in it entirety.

BACKGROUND

The present invention generally relates to pull type tools, and more specifically relates to a load control mechanism for pull type tools, such as a pull type tool for removing a rivetless nut plate.

Fasteners used in association with fluid tanks, such as fuel tanks or water tanks, for aircraft or the like present a problem in preventing leakage through the openings for the fasteners. Fasteners used in such installations may include a nut plate and a nut which are part of an assembly. There are many different design configurations of nut plates being used today. Two major classes are riveted nut plates and rivetless nut plates.

In riveted nut plates, two rivets are employed for attaching the body of the nut plate to the workpiece. To eliminate the potential for leakage, sealant is used between the structure and the nut plate.

With regard to rivetless nut plates, some designs provide that a sleeve is flared against a workpiece. One example of this type of rivetless nut plate is disclosed in U.S. Pat. No. 4,732,518, which is hereby incorporated herein by reference in its entirety. The '518 patent illustrates the insertion of a sleeve inside a workpiece against heavy interference forces and then deformation of the sleeve to produce flaring of the end of the sleeve. The sleeve has a serration/lobe configuration thereon with the serration/lobe configuration being long and tapered such that the serrations/lobes extend into the walls of the workpiece. The tapered feature, length and specific geometry are necessary to make installation possible with the method of installation which was chosen for its application. The main object of the '518 patent with its tapered and extended serration/lobe configuration was to enhance the fatigue life of the workpiece by distributing the load throughout the workpiece and providing expansion due to the insertion of the sleeve into the workpiece, and to cold work the material adjacent the perimeter of the workpiece aperture.

Other nut plate designs do not rely on flaring of the sleeve. U.S. Pat. Nos. 5,096,349, 5,245,743, 5,405,228 and pending U.S. application Ser. No. 10/272,721 (filed Oct. 17, 2002) and Ser. No. 10/929,701 (filed Aug. 30, 2004) disclose rivetless nut plate designs which do not rely on flaring of the sleeve, and these five items are hereby incorporated herein by reference in their entirety. While some rivetless nut plate designs rely on adhesive for attaching the nut plate to the structure, the designs disclosed in the five items cited above rely on heavily cold-worked holes and high interference engagement utilizing a hardened pin as the installation tool to expand a sleeve element into engagement with a workpiece structure. Because of high level expansion, the friction forces created are intended to retain the nut plate and provide expected mechanical properties.

Once installed, most rivetless nut plates are removed by drilling out the flared sleeve portion, or by drilling out the rivets while holding the nut plate. Drilling out the rivets and the sleeve from the holes requires a special skill. The procedure, aside from being cumbersome and time consuming, leaves behind contaminating metal chips. Additionally, it often enlarges the hole size requiring an oversized nut plate for replacement. Safety considerations, for drilling out the old nut plate, are required to prevent damage to surrounding structure and the operator.

U.S. patent application Ser. No. 11/218,076 discloses a plurality of tools which can be used to remove rivetless nut plates. Some of the designs disclosed in U.S. patent application Ser. No. 11/218,076 provide that a pull type power tool, such as a riveter, can be used to remove a rivetless nut plate. However, the actual working load necessary to complete the removal operation is much lower than the load provided by the riveter. Unfortunately, there is typically no way to control and limit the load that is applied.

Riveters are typically used to install break-stem fasteners. In such case, the load which is ultimately applied by the riveter during operation is effectively limited by the breakage of the stem at a certain load, thereby preventing the tool from overload. However, in applications where a riveter is not being used to install a break-stem fastener, such as where the riveter is being used to remove a rivetless nut plate, there is no such inherent load control feature, and there exists a critical need to control the working load in order to provide means for safe operation and prevent tool breakage.

While riveters are available in different power ratings, the load provided by the available selection of riveters is too high to be used to remove rivetless nut plates. The high load leads to overloading of the parent material (i.e., the workpiece in which the rivetless nut plate is installed), or certain tool components. It is disadvantageous to overload the tool during operation, as overloading will cause critical failure of the tool.

OBJECTS AND SUMMARY

An object of an embodiment of the present invention is to provide a load control mechanism for pull type tools.

Another object of an embodiment of the present invention is to provide a load control mechanism which provides that a riveter can be used to remove a rivetless nut plate without breaking a mandrel and without causing undue wear on components of the tool.

Briefly, and in accordance with at least one of the foregoing objects, an embodiment of the present invention provides a load control mechanism for use with a pull type tool, wherein the mechanism includes a telescopic housing and a compressible element, such as a polyurethane compression spring, which works to limit the ultimate load which is applied by the pull type tool during operation, such as during removal of a rivetless nut plate. As such, another aspect of the present invention provides a method of removing a rivetless nut plate by using a pulling head which includes a telescopic housing and a compressible element.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
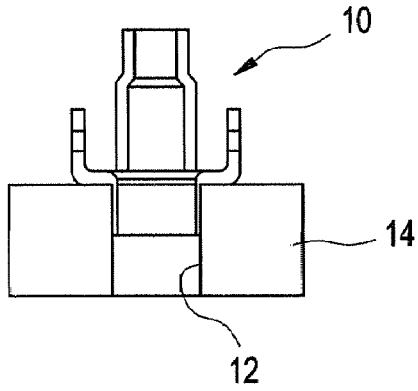
FIG. 1 PRIOR ART
FIG. 1 is cross-sectional view of an installed rivetless nut plate which needs to be removed.

While the present invention may be susceptible to embodiment in different forms, there is shown in the drawings, and herein will be described in detail, an embodiment thereof with the understanding that the present description is to be considered an exemplification of the principles of the invention and is not intended to limit the invention to that as illustrated and described herein.

One embodiment of the present invention provides a load control mechanism which can be used in association with pull type tools. For example, the load control mechanism can provide that a riveter can be used to remove a rivetless nut plate without breaking a mandrel and without causing undue wear on components of the tool.

FIG. 1 illustrates a rivetless nut plate 10 which is installed in a hole 12 in a workpiece (i.e., parent material) 14 and needs to be removed. The rivetless nut plate 10 may be as disclosed in U.S. application Ser. No. 10/272,721 (filed Oct. 17, 2002) and Ser. No. 10/929,701 (filed Aug. 30, 2004), both of which have been incorporated herein by reference in their entirety.

Figure 2:
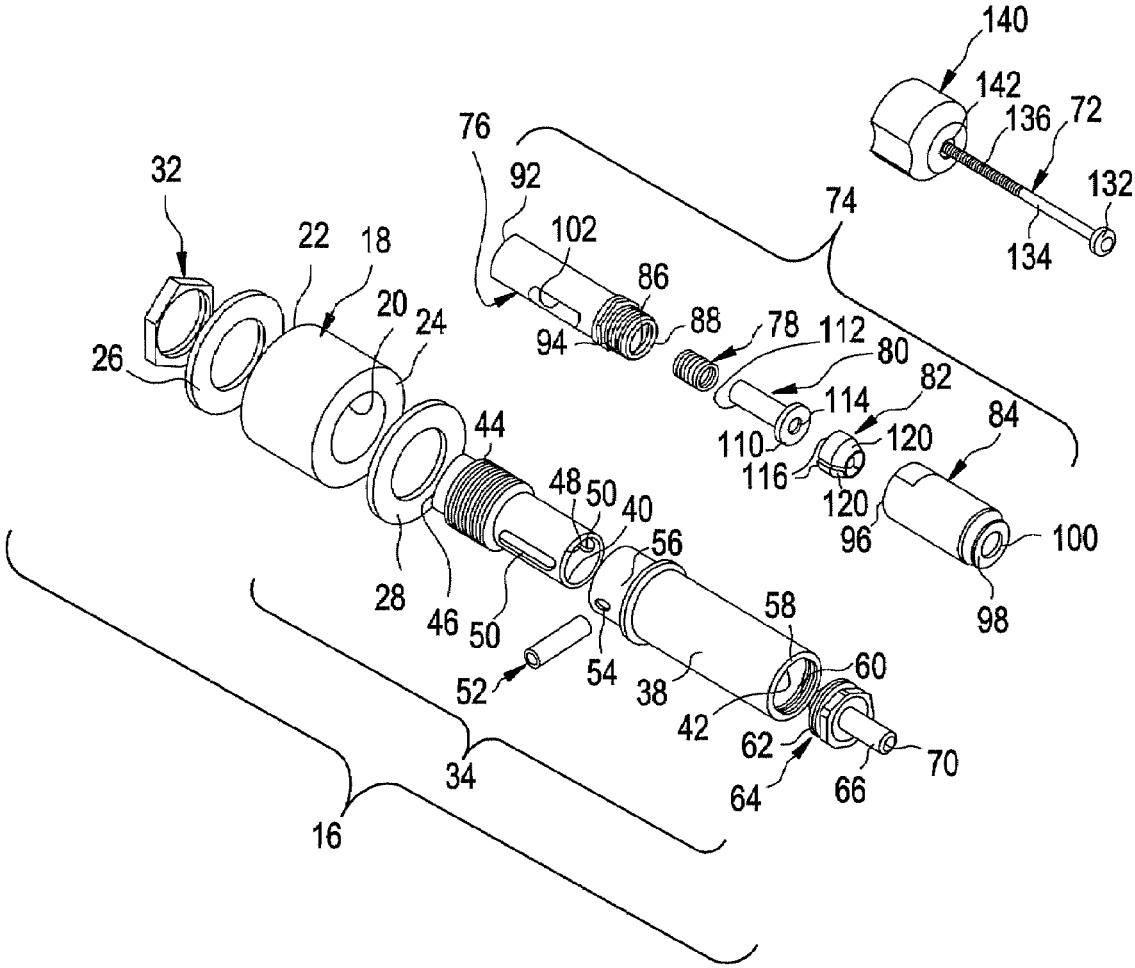
FIG. 2 is an exploded perspective view of a pulling head which is in accordance with an embodiment of the present invention.

FIG. 2 illustrates a pulling head 16 which includes a load control mechanism which is in accordance with an embodiment of the present invention. The pulling head 16 is configured for use with a power tool (i.e., a pull type tool such as a riveter) such as described in U.S. Pat. No. 5,425,164, which is hereby incorporated herein by reference in its entirety. Such a tool is available from Textron as Hand Hydraulic Riveter Model G750A, and includes a housing and a piston for pulling. Alternatively, Textron's Lightweight CherryMax® Power Tool Model G704B may be used, or some other appropriate power tool. Operation of the pulling head 16 with regard to the power tool will be described in more detail hereinbelow.

Figure 3:
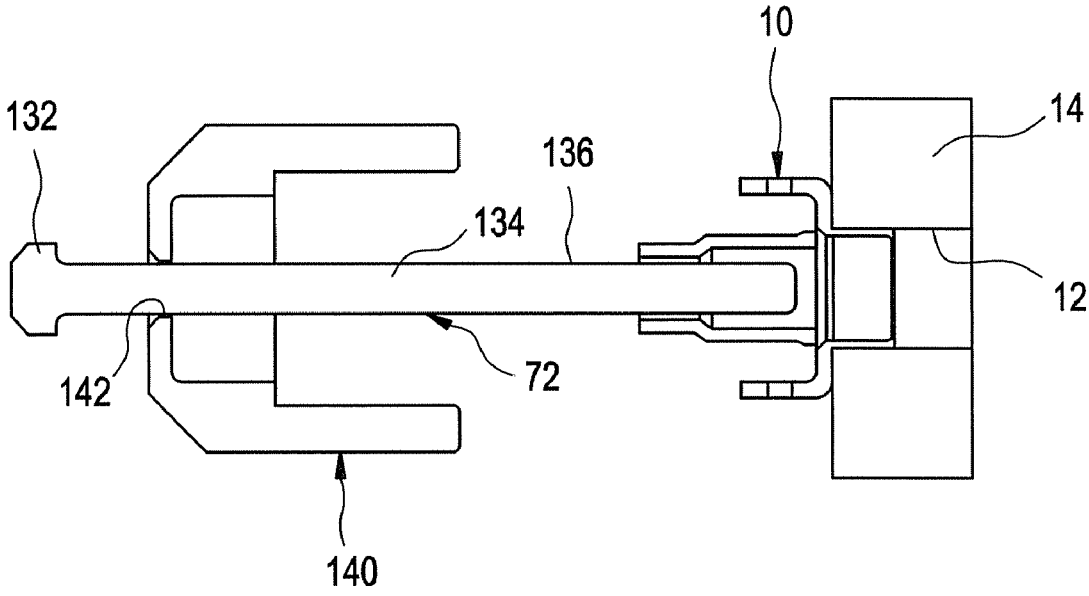
FIG. 3 is a view showing a mandrel being pushed through a reaction cup and through the middle of the rivetless nut plate of FIG. 1.

As shown in FIGS. 2 and 3, the pulling head 16 includes a compressible element 18, such as a polyurethane element. This element 18 is generally cylindrical having a throughbore 20. Proximate each end 22, 24 of the compressible element 18 is a load transfer washer 26, 28. At the back end 30 of the pulling head 16 is a jam nut 32. The jam nut 32, which controls pre-load, is adjustable thereby effectively facilitating load adjustment.

The pulling head 16 includes a housing 34 housing which includes two components 36, 38 which telescope relative to each other during operation of the pulling head 16, as will be described in more detail hereinbelow. Each housing component 36, 38 is generally cylindrical having a longitudinal throughbore 40, 42. A rear housing component 36 includes an externally threaded portion 44 proximate its back end 46 for threaded engagement with the housing of a pull type tool, such as a riveter as discussed above. Proximate a front end 48 of the rear housing component 36 are two slots 50 which are configured to receive a dowel pin 52. Specifically, the dowel pin 52 extends through holes 54 provided in a sidewall 56 of the front housing component 38 as well as through the slots 50 in the rear housing component 36. As such, the front housing component 38 and the rear housing component 36 are effectively attached to each other, but can telescope relative to each other.

A front end 58 of the front housing component 38 includes an internally threaded section 60 (i.e., a front end 58 of the longitudinal bore 42 is threaded) for threaded engagement with a corresponding external threaded portion 62 of a nose insert 64. The nose insert 64 includes an extending front portion 66 which defines the front 68 of the pulling head 16, and a longitudinal throughbore 70 into which a mandrel 72 extends during operation of the pulling head 16, as will be described in more detail hereinbelow.

Inside the two-part telescopic housing 34 is a drawbolt assembly 74, which includes a drawbolt 76, a compression spring 78, a jaw follower 80, a set of jaws 82 which are configured to grip the mandrel 72 during operation of the pulling head 16, and a collet 84. The drawbolt 76 is generally cylindrical with a bore 86 provided at its front end 88 and a threaded bore 90 provided at its rear end 92. The threaded bore 90 is provided at the rear end 92 of the drawbolt 76 so the drawbolt 76 can be threaded onto a piston of the pull type tool. Additionally, an externally threaded portion 94 is provided proximate the front end 88 of the drawbolt 76 for threading into a rear end 96 of the collet 84. The collet 84 is generally cylindrical having an opening 98 in its front end 100. Like the rear housing component 36, the drawbolt 76 includes a pair of slots 102 which receive the dowel pin 52.

Figure 5:
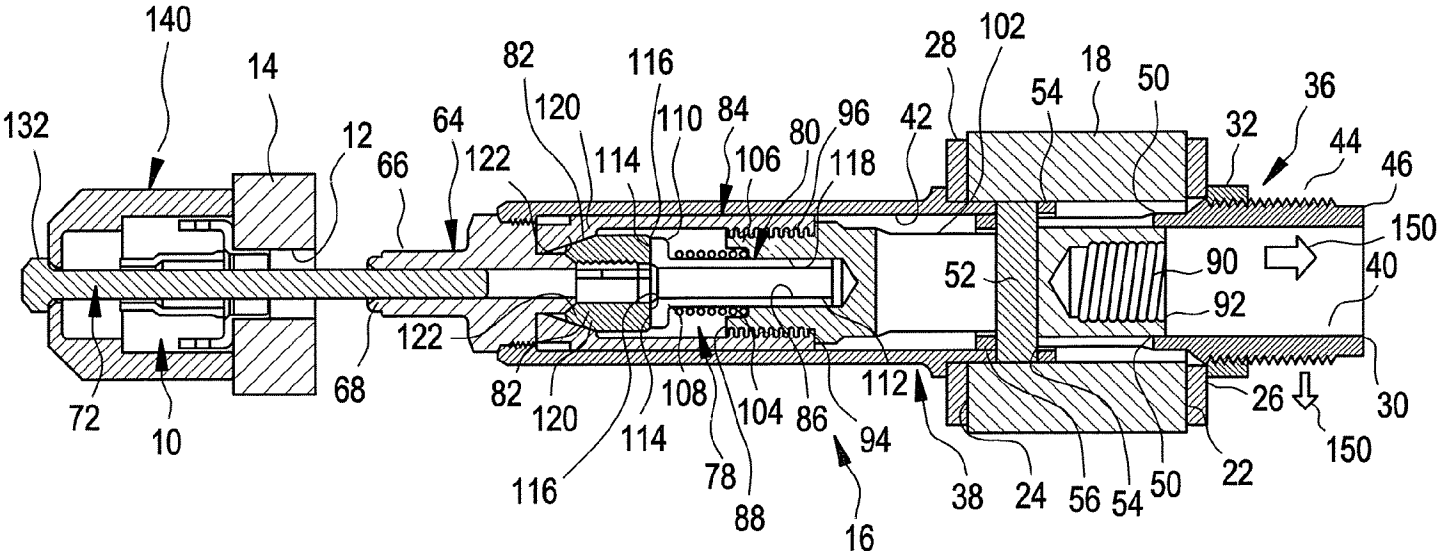
FIG. 5 is a view showing the mandrel being inserted into the pulling head of FIG. 2.

As shown in FIG. 5, a rear end 104 of the compression spring 78 sits in a recess 106 which is provided proximate the front end 88 of the drawbolt 76, and a front end 108 of the compression spring 78 engages a shoulder 110 of the jaw follower 80. A rear end 112 of the jaw follower 80 extends into the bore 86 which is provided in the front end 88 of the drawbolt 76, and a front, facing surface 114 of the jaw follower 80 contacts a back surface 116 of the jaws 82. But for the shoulder portion 110 of the jaw follower 80 and the front, facing surface 114, the jaw follower 80 is generally cylindrical having a longitudinal throughbore 118.

As shown in FIG. 2, the pulling head 16 may be provided as having a pair of internal jaws 82, where each jaw 82 has a tapered surface 120 for engaging a corresponding tapered internal wall 122 (see FIG. 6) inside the collet. As discussed above, the compression spring 78 is disposed between the drawbolt 76 and the shoulder 110 of the jaw follower 80. As such, the compression spring 78 tends to push the jaw follower 80, and the jaws 82 forward in the pulling head 16. The pushing of the compression spring 78 on the jaw follower 80 and the contacting engagement of the tapered surface 120 of the jaws 82 with the corresponding tapered internal wall 122 inside the collet 84, tends to force the jaws 82 closed. An inner surface 124 of each of the jaws 82 provides serrations for gripping a mandrel 72.

Figure 6:
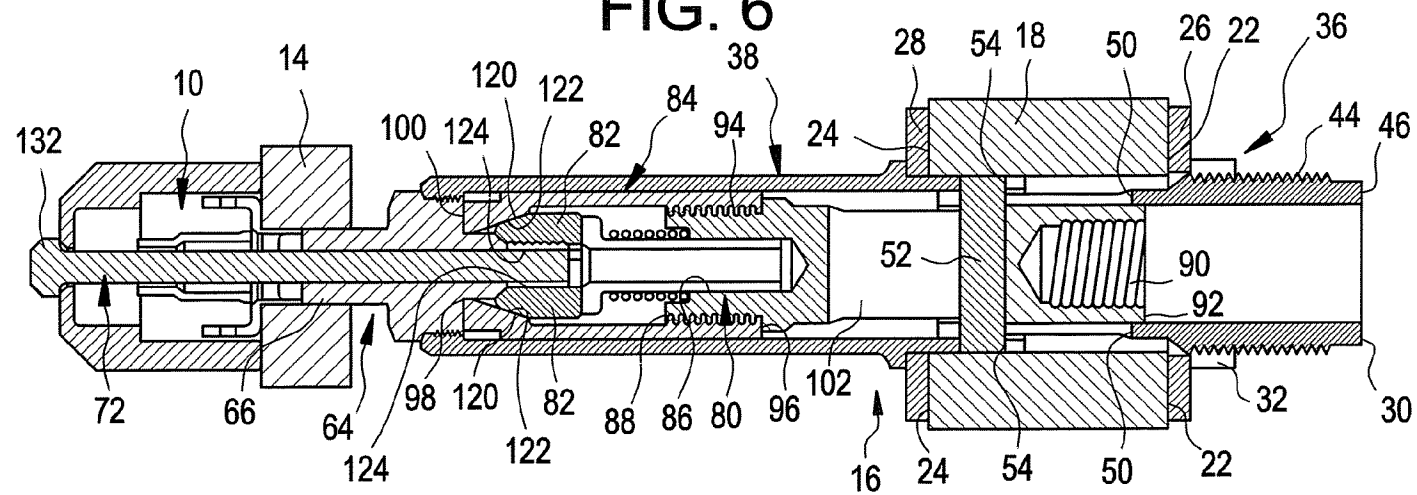
FIG. 6 is a view showing a front of the pulling head being inserted into the hole in which the rivetless nut plate is installed.

Although the spring bias of the jaws 82 and the engagement of the tapered surface 120 of the jaws 82 with the corresponding tapered internal wall 122 inside the collet 84 tends to force the jaws 82 closed, preferably each jaw 82 also includes a front surface 126 (identified in FIG. 7) which is tapered inwardly. When the jaws 82 are most forward in the pulling head 16, such as is shown in FIG. 5, the inwardly tapered surface 126 of each of the jaws 82 engages a corresponding tapered surface 130 (identified in FIG. 8) which is provided at the back end 62 of the nose insert 64, said engagement tending to force the jaws 82 open for easy insertion of a mandrel 72 as shown in FIG. 6. Due to the jaws 82 being effectively held open by the back end 62 of the nose insert 64, it is easier to insert a mandrel 72 into the pulling head 16, and there is reduced wear associated with doing so.

Also provided, for operation of the pulling head 16, is the mandrel 72 which has a head portion 132 which is provided at the end of a shaft 134. Ribs 136 are provided on the shaft 134 for gripping by the jaws 82. Also provided is a reaction cup 140 which is generally hollow and cylindrical, having a hole 142 large enough to receive the shaft 134 of the mandrel 72, but being too small to allow the head 132 of the mandrel 72 to pass through.

Figure 4:
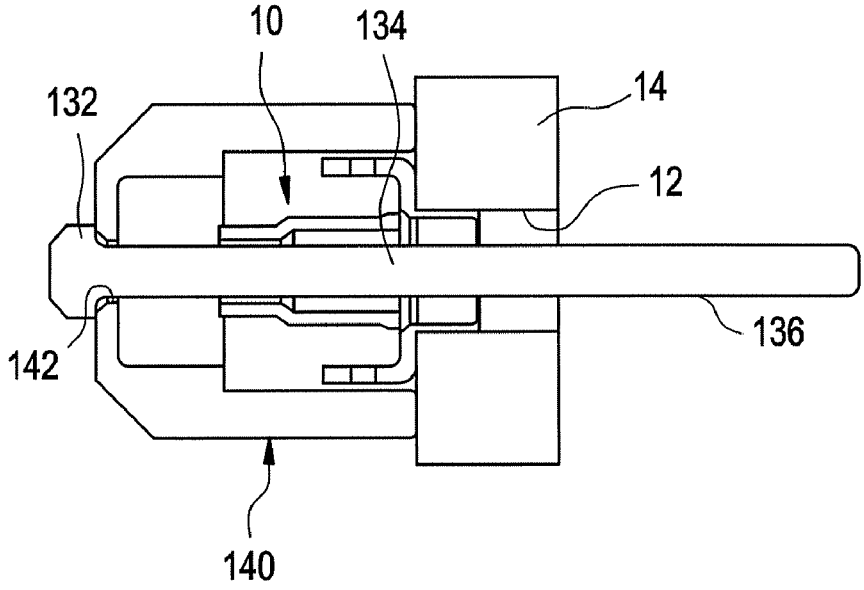
FIG. 4 is a view showing the reaction cup being pushed against the workpiece.

In use, initially as shown in FIG. 1, there is provided a rivetless nut plate 10 which must be removed from a hole 12 in a workpiece 14 (i.e., the parent material). As shown in FIG. 3, first the shaft 134 of the mandrel 72 is extended through the hole 142 in the reaction cup 140, and the reaction cup 140 is seated against the parent material 14, as shown in FIG. 4, such that the head 132 of the mandrel 72 contacts the reaction cup 140. As shown in FIG. 5, the shaft 134 of the mandrel 72 is inserted into the end 68 of the pulling head 16 (i.e., into the opening 70 in the nose insert 64) and the front end 68 of the pulling head 16 (i.e., the extending portion 66 of the nose insert 70) is inserted in the hole 12 in the parent material 14, in contact with the rivetless nut plate 10 as shown in FIG. 6. During this time, the jaws 82 are generally kept open as a result of the jaws 82 being spring-biased forward (viz-a-viz the spring 78 pushing on the shoulder 110 of the jaw follower 80) into contact with the nose insert 64. As discussed above, the rear end 62 of the nose insert 64 is provided with an angled surface 130 which contacts corresponding inwardly tapered surfaces 126 on the jaws 82, causing the jaws 82 to be forced open.

Figure 7:
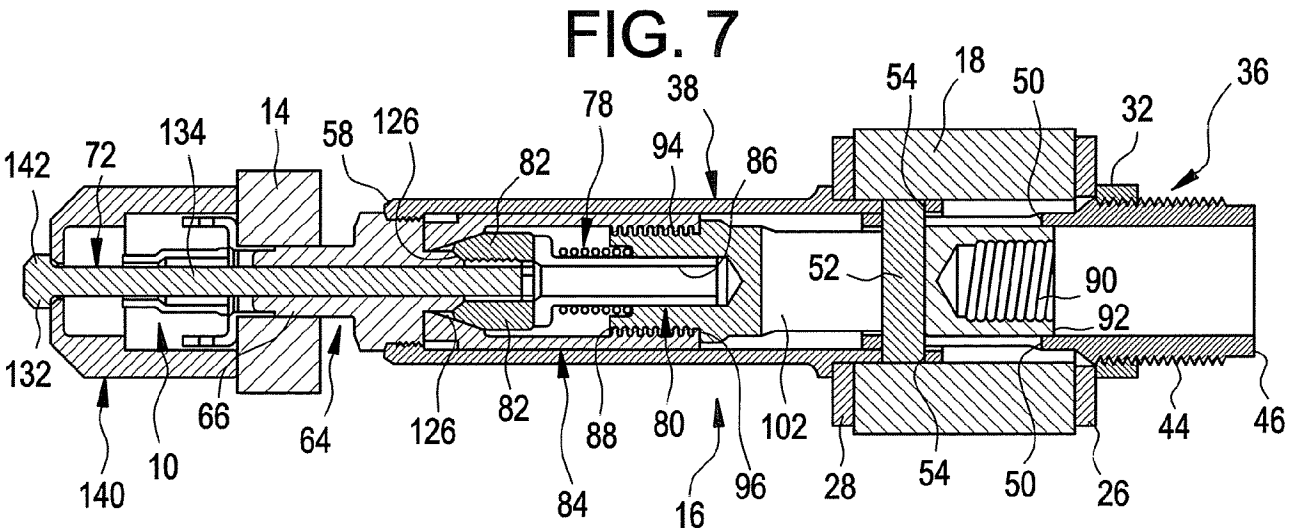
FIG. 7 is a view showing the riveter, to which the pulling head is attached, being actuated causing jaws of the pulling head to grip the mandrel.

Then, the pull type tool (i.e., riveter) to which the pulling head is engaged (engagement with a riveter is represented in FIG. 5 using arrows 150) is actuated, causing the piston of the riveter to pull the drawbolt 76 back, causing the collet 84 to also move back. Such relative movement between the collet 84 and the jaws 82 causes the jaws 82 to slide up the tapered surface 122 in the collet 84 and grip the mandrel 72 as shown in FIG. 7, thereby applying a force which is also applied to the rivetless nut plate 10.

Figure 8:
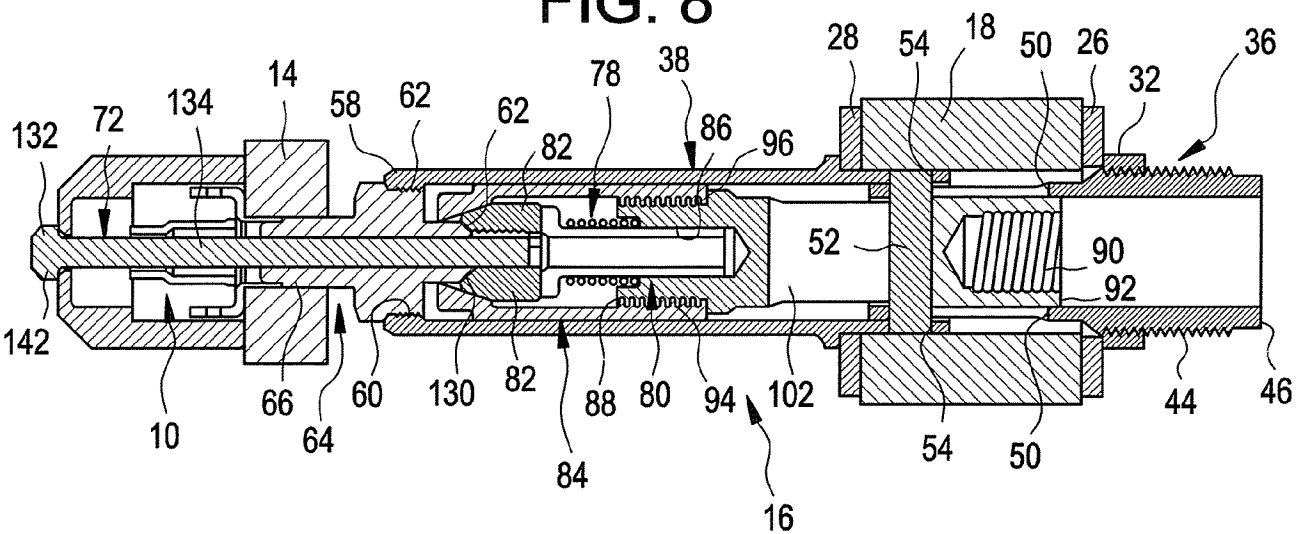
FIG. 8 is a view showing the riveter being further actuated, causing a front of the pulling head to push the rivetless nut plate out of the hole, during which time a collapsible element of the pulling head is collapsing.

As the riveter continues to be actuated, the drawbolt 76 and collet 84 keep moving back in the housing 34 and the jaws 82 keep pulling on the mandrel 72 as shown in FIG. 8. As long as the force is lower than the force necessary to push the rivetless nut plate 10 out of the hole 12 in the parent material 14, the telescopic housing 34 of the pulling head 16 collapses, forcing the compressible element 18 to compress, and the force continues to build up in the compressive element 18 (i.e., the compressible element 18 continues to be compressed).

Figure 9:
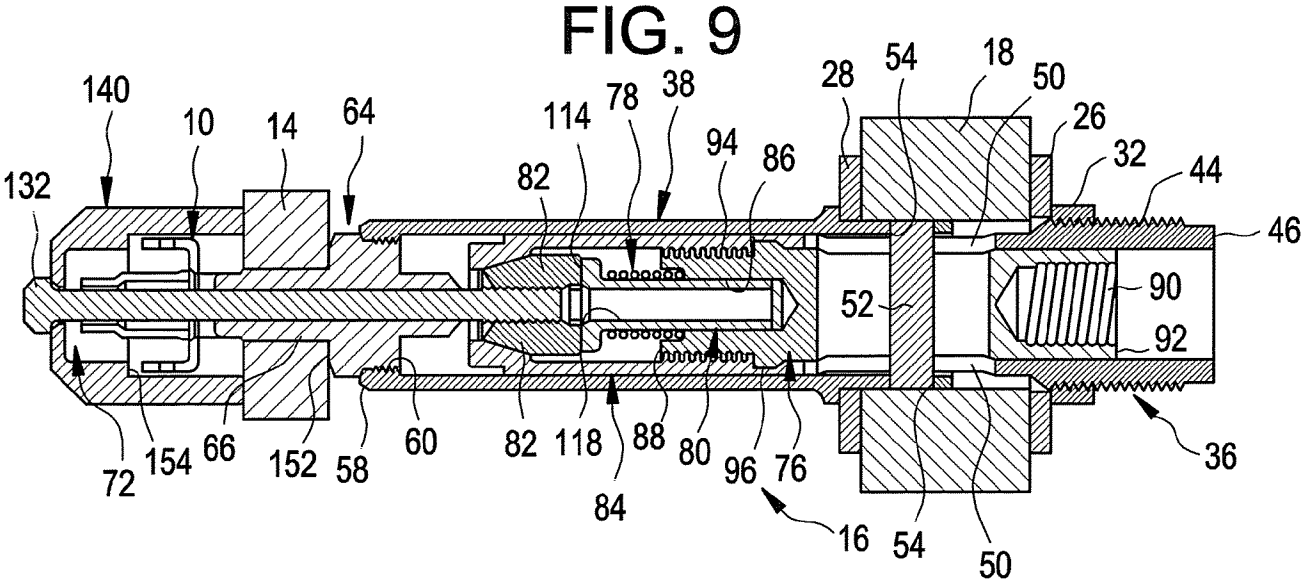
FIG. 9 is a view showing the riveter being further actuated, causing the front of the pulling head to push the rivetless nut plate completely out of the hole, during which time the collapsible element of the pulling head further collapses.

When the force built up in the compressive element 18 equals the push out force of the rivetless nut plate 10 to be removed, the collapse stops and the nut plate 10 is removed as shown in FIG. 9. Additional travel/load will only increase the load incrementally, at a known rate. When the face 152 of the nose insert is pushed against the parent material, or the nut plate riveter 10 is pushed against the back 154 of the reaction cup 140, as shown in FIG. 9, the housing 34 keeps collapsing, increasing the load slightly. However, the compressive element 18 provides that only a portion of the overall load applied by the riveter is actually applied to the active area. For example, depending on the riveter and the properties of the compressive element, out of say 3100 lbs. (depending on the riveter) applied by the riveter, only 500 lbs. (depending on the properties of the compressive element 18) is applied to the active area, keeping the parent material 14 from becoming damaged, keeping the mandrel 72 from breaking, and keeping tool components from experiencing undue wear.

Figure 10:
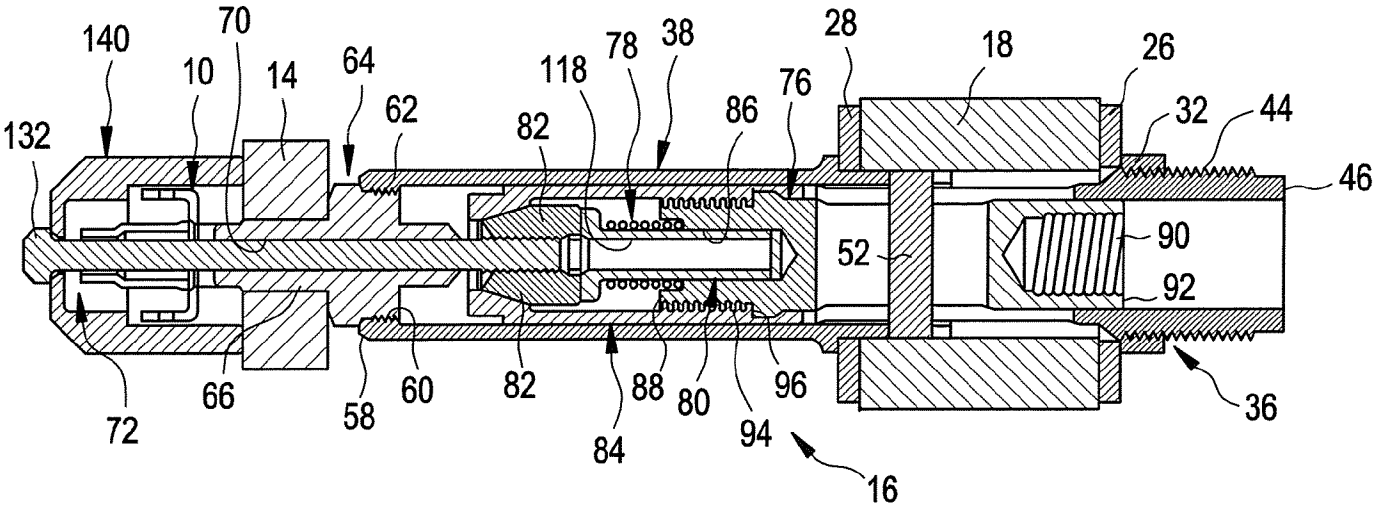
FIG. 10 is a view showing the pulling head after a trigger of the riveter has been released, causing a housing of the pulling head to retract to its initial position.
Figure 11:
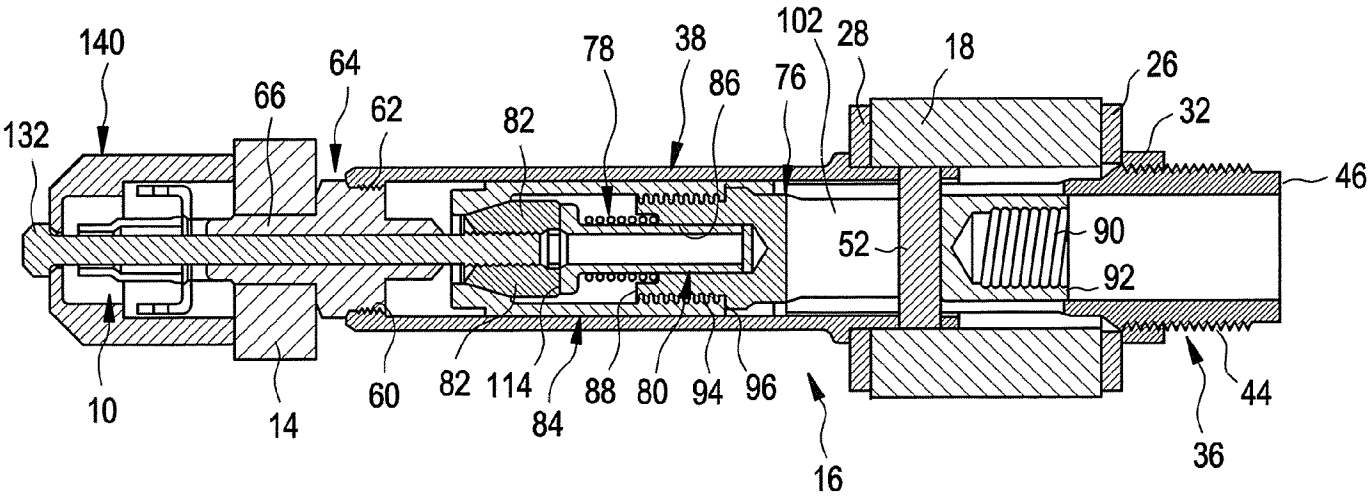
FIG. 11 is a view showing the pulling head at the end of the return, at which time the jaws of the pulling head release the mandrel.
Figure 12:
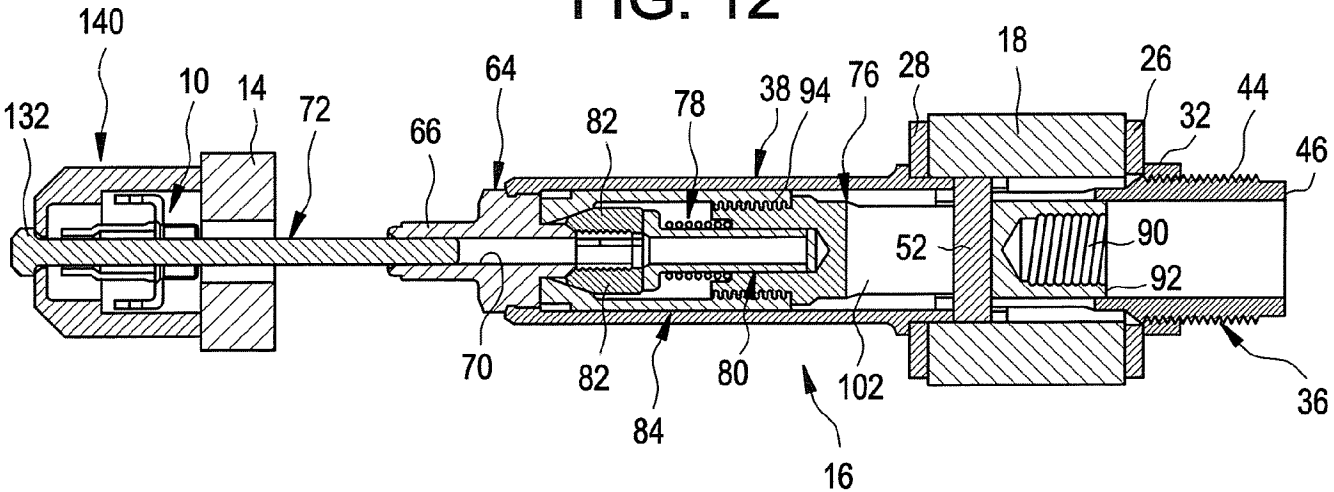
FIG. 12 is a view showing the front of the pulling head being removed from the hole in which the rivetless nut plate was installed.
Figure 13:
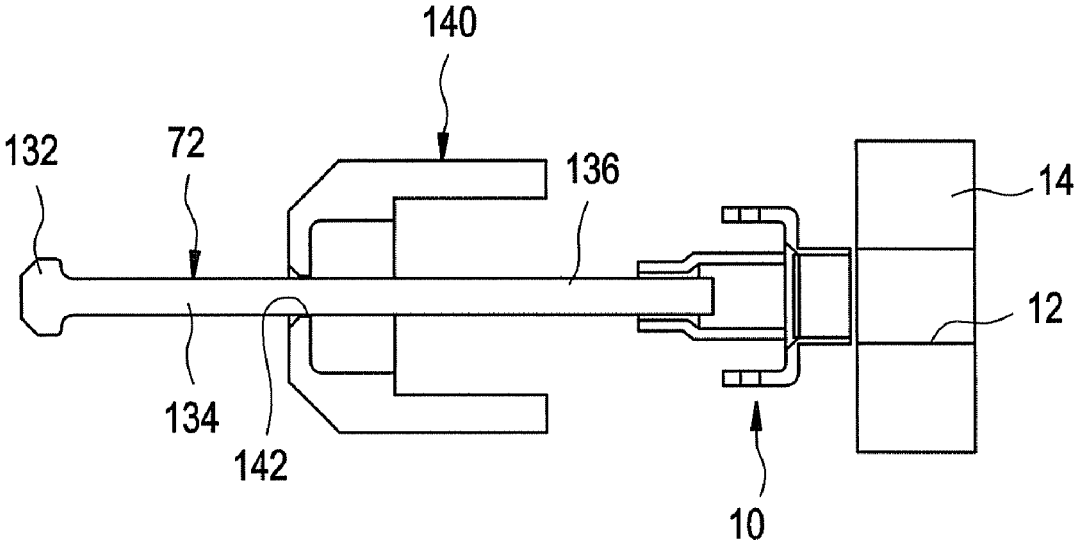
FIG. 13 shows the mandrel and the reaction cup being pulled away from the workpiece and rivetless nut plate.
Figure 14:
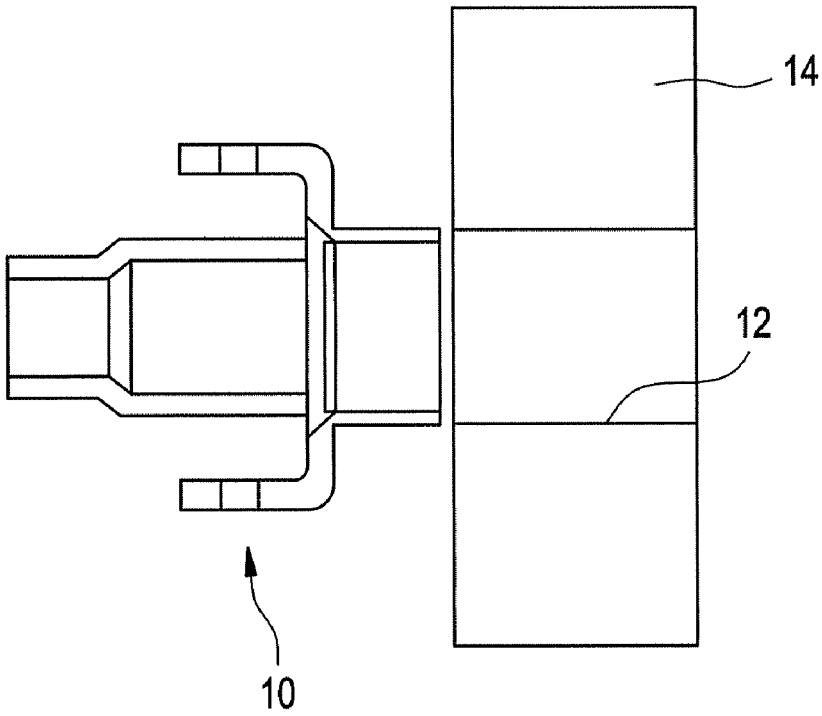
FIG. 14 shows the rivetless nut plate being discarded.

When the nut plate removal is completed, the trigger of the riveter can be released, thereby causing the piston to push the drawbolt 76 forward and causing the housing 34 to expand, as shown in FIG. 10. The drawbolt 76 is pushed forward until the riveter reaches the end of its stroke. At the end of the stroke, the jaws 82 are pushed into the back tapered surface 126 of the nose insert 64, forcing the jaws 82 open. As such, the mandrel 72 is now free, and the pulling head 16 can be pulled away from the mandrel 72 and parent material 14, as shown in FIG. 12. Then, as shown in FIG. 13, the mandrel 72 and reaction cup 140 are pulled away from the parent material 14, and the removed fastener 10 can thereafter be discarded, as shown in FIG. 14.

The load control mechanism described hereinabove, i.e., the telescopic housing 34 working together with the compressive element 18, etc., works to absorb some of the load exerted by a pull type tool during load application, such as while using a riveter to remove a rivetless nut plate. As such, the load control mechanism allows a pull type tool to be used in applications in which the pull type tool would otherwise be overrated. For example, the load control mechanism provides that a riveter, such as a riveter which typically applies 3100 lbs. at 90 p.s.i., can be used to remove a rivetless nut plate without breaking a mandrel, causing undue wear on components of the tool, or damaging the parent material.

While embodiments of the present invention are shown and described, it is envisioned that those skilled in the art may devise various modifications of the present invention without departing from the spirit and scope of the disclosure.

What is claimed is:

1. A pulling head configured for use with a pull type tool, said pulling head comprising: a telescopic housing configured to engage the pull type tool; a compressible element on the housing and configured to limit the ultimate load which is applied by the pull type tool during operation, wherein the telescopic housing comprises a first housing component and a second housing component, wherein said first and second housing components are configured to telescope relative to each other, wherein the first housing component comprises a threaded component which is configured to threadably engage a housing of the poll type tool; a pin which is engaged with the second housing component, wherein the first housing component includes two slots, wherein the pin extends through the slots in the first housing; and a drawbolt assembly which is disposed in the telescopic housing, wherein said drawbolt assembly comprises a drawbolt and collet, wherein the drawbolt has a front end and a heck end, and is generally cylindrical with a bore provided at its front end and a threaded bore provided at its rear end, wherein the threaded bore provides that the drawbolt is threadable onto a piston of the pull type tool, wherein an externally threaded portion is provided proximate the front end of the drawbolt for threading into a rear end of the collet, wherein the collet is generally cylindrical having an opening in its front end, wherein the drawbolt includes a pair of slots which receive the pin, wherein the drawbolt assembly further comprises a compression spring, a jaw follower, and a set of jaws which are configured to grip a mandrel during operation of the pulling head, wherein a rear end of the compression spring sits in a recess which is provided proximate the front end of the drawbolt, and a front end of the compression spring engages a shoulder of the jaw follower, wherein a rear end of the jaw follower extends into the bore which is provided in the front end of the drawbolt, and a front, facing surface of the jaw follower contacts a back surface of the jaws.

2. A pulling head as recited in claim 1, wherein the compressible element comprises a polyurethane element.

3. A pulling head as recited in claim 1, wherein the compressible element is generally cylindrical and includes a throughbore.

4. A pulling head as recited in claim 1, further comprising a load transfer washer in contact with each end of the compressible element.

5. A pulling head as recited in claim 1, wherein each jaw has a tapered surface configured for engaging a corresponding tapered internal wall inside the col let, wherein the compression spring tends to push the jaw follower, and the jaws forward in the pulling head, wherein the pushing of the compression spring on the jaw follower and contacting engagement of the tapered surface of the jaws with the corresponding tapered internal wall inside the collet, tends to force the jaws closed.

6. A pulling head recited in claim 5, further comprising a nose insert, wherein the jaws arc held open by a back and of the nose insert.

7. A pulling head as recited in claim 1, wherein the compressible element is configured to limit a load which is applied by the pull type tool during operation.

8. A pulling head as recited in claim 1, wherein the compressible element includes a throughbore, wherein the telescopic housing comprises a first housing component and a second housing component, wherein said first and second housing components an configured to telescope relative to each other, wherein at least a portion or the first housing component and the second housing component are disposed in the throughbore of the compressible element.

9. A pulling head as recited in claim 8, further comprising a pin which is engaged with the second housing component, wherein the first housing component includes two slots, wherein the pin extends through the slots in the first housing, wherein the pin is disposed in the throughbore of the compressible element.

10. A pulling head as recited in claim 1, wherein the first housing component is externally treaded.

11. An apparatus configured for use with powered riveters for removing a rivetless nut plate, said apparatus comprising:

a nose insert sized specifically for a hole from which the rivetless nut plate needs to be removed, a two part housing comprising a first housing and a second housing which telescope relative to each other, connected by an adjustable shock absorbing element, wherein the nose insert is threadably engaged with the two part housing, wherein the two part housing is threadably engageable with a stationary part of the riveter, an internal drawbolt assembly comprised of a collet containing a set of conical jaws with internal serrations, a drawbolt, a jaw follower, a compression spring, and an adaptor having a transversal elongated slot, wherein a rear end of the compression spring sits in a recess which is provided proximate the front end of the drawbolt, and a front end of the compression spring engages a shoulder of the jaw follower, wherein a rear end of the jaw follower extends into the bore which is provided in the front end of the drawbolt, and a front, facing surface of the jaw follower contacts a hack surface of the jaws, a cross pin connecting the first housing and the second housing to each other and to the internal drawbolt, wherein said internal drawbolt is slidable independently from the two part housing due to a traversal elongated slot hut may not rotate, wherein said internal drawbolt assembly is threadably engageable with a movable part of the riveter, providing the operating force, a reaction cup placed around the rivetless nut plate to be removed, and a serrated mandrel supported by the reaction cup, wherein said conical jaws engage and pull on the mandrel effectively pushing the nose insert towards the rivetless nut plate to be removed.

12. A pulling head as recited in claim 11, equipped with an adjustable shock absorbing element.

13. A pulling head as recited in claim 12, wherein the shock absorbing element is configured to limit the operating load regardless of the power available from the riveter.

14. A pulling head as recited in claim 13, wherein the first housing component comprises an externally threaded component which is configured to threadably engage a housing of the pull type tool.

15. A pulling head as recited in claim 14, further comprising an internal drawbolt assembly including elongated cross slots.

16. A pulling head as recited in claim 11, wherein said two part housing is fitted to the hole size in the workpiece by the means of a threaded insert.

17. A pulling head as recited in claim 16, wherein the first housing component have elongated cross slob and second housing has cross holes.

18. A pulling head as recited in claim 17, wherein the first housing, second housing and drawbolt are capable to translate independently from each other but are kept together and prevented from rotating by a cross pin placed inside of the shock absorbing element.

* * * * *

UNITED STATES PATENT AND TRADEMARK OFFICE

CERTIFICATE OF CORRECTION

PATENT NO. : 7,698,794 B2
APPLICATION NO. : 11/733485
DATED : April 20, 2010
INVENTOR(S) : Christinel Ovidiu Cobzaru It is certified that error appears in the above-identified patent and that said Letters Patent is hereby corrected as shown below:

Title Page, Item (57) Abstract, line 9 "a resetion cup" should be -- a reaction cup --

Column 7, Line 3 "a heck end," should be -- a back end, --

Column 7, Line 32 "the col let" should be -- the collet --

Column 8, Line 27 "hut may not" should be -- but may not --

Column 8, Line 53 "cross slob" should be -- cross slots --

Signed and Sealed this

Thirtieth Day of November, 2010

David J. Kappos

David J. Kappos
*Director of the United States Patent and Trademark Office*